US006112499A

United States Patent [19]

Lyskawa et al.

[11] Patent Number: 6,112,499

[45] Date of Patent: Sep. 5, 2000

[54] BAG CLOSURE APPARATUS

[75] Inventors: Donald V. Lyskawa, Grafton, Wis.; Tamio Morishita, Hyogo-Pref, Japan

[73] Assignee: HellermannTyton Corporation, Milwaukee, Wis.

[21] Appl. No.: 09/232,585

[22] Filed: Jan. 19, 1999

[51] Int. Cl.[7] ..... B65B 51/04

[52] U.S. Cl. ..... 53/138.7; 53/139.1; 140/93.2

[58] Field of Search ..... 53/138.2, 138.4, 53/138.8, 138.7, 138.6, 478, 483, 139.1; 140/93.2; 24/16 FB

[56] References Cited

U.S. PATENT DOCUMENTS

| | | | |
|---|---|---|---|
| 3,946,769 | 3/1976 | Caveney et al. | 140/93.2 |
| 4,640,320 | 2/1987 | Avison et al. | 140/93.2 |
| 4,790,225 | 12/1988 | Moody et al. | 140/93.2 |
| 5,205,328 | 4/1993 | Johnson et al. | 140/93.2 |

OTHER PUBLICATIONS

Four brochures on different "Tipper Tie" machines from Tipper Tie, Inc. ((C) 1995).

*Primary Examiner*—Peter Vo
*Assistant Examiner*—Louis Huynh
*Attorney, Agent, or Firm*—Ryan Kromholz & Manion,S.C.

[57] ABSTRACT

The present invention discloses a new and efficient apparatus with purpose of transporting individual cable ties to a workpiece area where an individual cable tie is directed to surround and cinch a workpiece within the workpiece area. Further this apparatus has the purpose to sever and dispose of surplus cable tie portions, and carrier strips as well as unwanted workpiece length.

26 Claims, 11 Drawing Sheets

BAG CLOSURE APPARATUS

BACKGROUND OF THE INVENTION

This invention relates to an automatic bench tool for automatic cable tie tensioning. The new automatic cable tie-tensioning tool illustrated herein is a special adaptation for closing workpiece bags containing shippable product.

In the past, workpiece bags have been closed with metal ties. However several persistent problems have plagued the efficiency of such ties. When metal ties are not properly formed, fluid within the workpiece bag is able to escape, causing leakage and mess. Further, many products sold within workpiece bags are sold by weight and any escape of fluid necessarily reduces the accuracy of measured unit weight. A wholesaler purchasing a product at one unit weight may discover that the product has lost weight in transit due to seepage around the tie area. The consumer too, experiences this difficulty. Further, juice from certain products such as poultry, is corrosive, thus the metal tie's efficiency is hampered by corrosion. These factors contribute to the need to create a tie made from a non-metallic substance. It is known to provide individual cable ties that an operator must apply individually as well as hold workpiece bags having the open ends bunched to accommodate the closing of the tie.

SUMMARY OF THE INVENTION

The invention comprises an apparatus for tying and cinching cable ties around workpieces to close an open end of a workpiece. Additionally, it is conceivable that this invention could be used for cinching other articles as for instance cinching lengths of tubular sausage sections.

In the preferred embodiment of the present invention, the apparatus is composed of a feeder mechanism, several reciprocating extending mechanisms, each moving a specific element of the apparatus, jaw elements, cutting elements, and a proximity sensor. The reciprocating extending mechanisms are known in the art and are preferably air cylinders, although any mechanism that achieves the same result may be used.

The preferred tying means to be used in accordance with the present invention is a plastic cable tie which is known in the art. The cable ties may be of any size, but it is preferred that they have a tail end and a head end, the head end having an aperture into which the tail end is to be inserted. It is also preferred that the body of the cable ties has a series of longitudinally spaced, upstanding ridges, cooperating with means for engaging the tail portion. Such means may comprise a ridge-engaging pawl conventionally located within the aperture of the head end. Prior to placement into the apparatus, the cable ties may be conjoined at one or both ends by way of a carrier strip. When the cable ties are conjoined in this way, they are easily bundled on a reel for facile dispensation into the apparatus. The cable ties are received by a feeder mechanism designed to separate the individual cable ties in readiness for tying.

The feeder mechanism is comprised of a rotating cylinder having a plurality of circumferentially spaced, re-entrant grooves designed to accept individual cable ties as it rotates. Adjacent the feeder mechanism is a proximity sensor positioned to provide an "off-on-off" signal to a sequentially operated electrical circuit device, such as a programmable logic controller.

As the cable ties rotate in the feeder mechanism's grooves, stationary cutting blades sever the carrier strip to separate the cable ties. Further rotation of the feeder mechanism places an individual strip in the path of the first reciprocating extending mechanism. The first reciprocating extending mechanism, such as an air cylinder, has as its purpose the transport of cable ties, tail end first, from the feeding mechanism to the surrounding and tensioning area. The operator inserts a previously bunched open end of a filled workpiece, such as a thin film plastic bag, into this area.

As the cable tie approaches this area, a pair of reciprocating extending mechanisms moves opposed jaw members to surround and direct the incoming cable tie to form the tie into a closed loop. The first jaw to contact the cable tie is configured to have, as a feature, a channeled concave surface arranged to receive and guide the cable tie. As the cable tie curves within the confines of the channel to the general shape of the jaw member, it meets and engages the second jaw member. The second jaw member effectively surrounds the cable tie and directs its tail into the aperture in the head of the same cable tie and is retained in the head by fastening means, such as an integrally formed pawl engagable with the longitudinally spaced ridges on an elongated surface of the cable tie.

After the tail portion of the cable tie passes through the aperture, a third reciprocating extending mechanism directs a grasping means toward the tail portion. The grasping mechanism attaches itself to the tail portion while its reciprocating extending mechanism returns to its normal operating position. This return to position creates tensioning of the tail portion as the cable tie length is pulled through its apertured head. As the grasping mechanism tensions the cable tie, a cutting tool, operated by another reciprocating extending mechanism, severs the surplus cable tie free end portion.

An additional reciprocating extending mechanism moves a guillotine blade to sever undesired excess workpiece portion. The guillotine blade is interchangeable between two blade positions.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
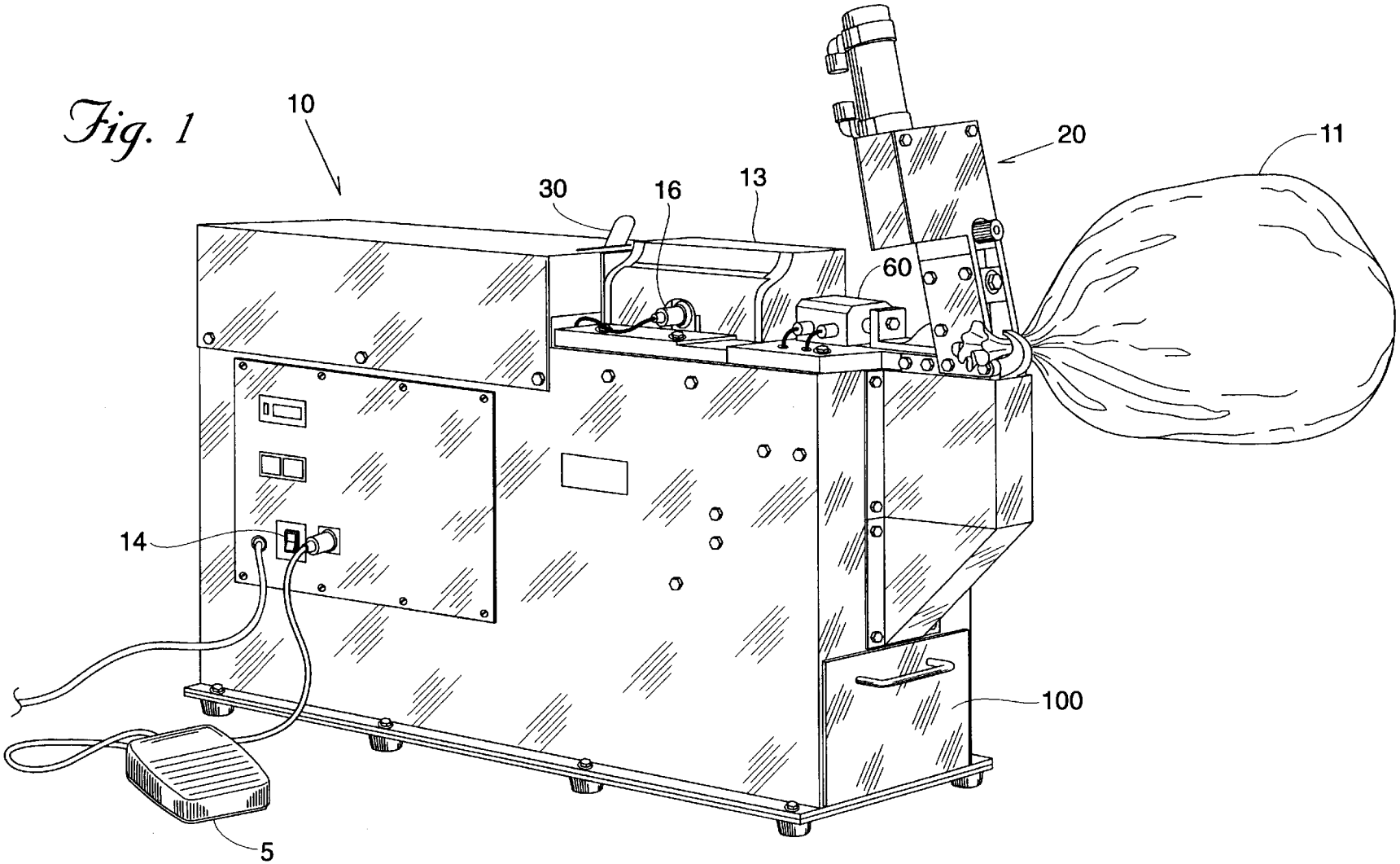
FIG. 1 is a perspective view of one embodiment of the cable tie insertion, forming and tensioning apparatus.

With reference to FIG. 1, the general operating components are disclosed. A preferred embodiment of the invention includes the apparatus 10 with a workpiece 11, shown as a flexible bag. Although shown in conjunction with a workpiece bag 11, it is to be understood that the apparatus 10 may be used on a variety of variously configured workpieces, each having an open end to be cinched. FIG. 1 also shows several external characteristics of the apparatus 10, including the upright guillotine tower 20, feeder mechanism housing 13, manual operated indexing handle 30 which will be later described, visible portions of the proximity sensor 16, foot pedal 5, power switch 14, and waste drawer 100.

Figure 2:
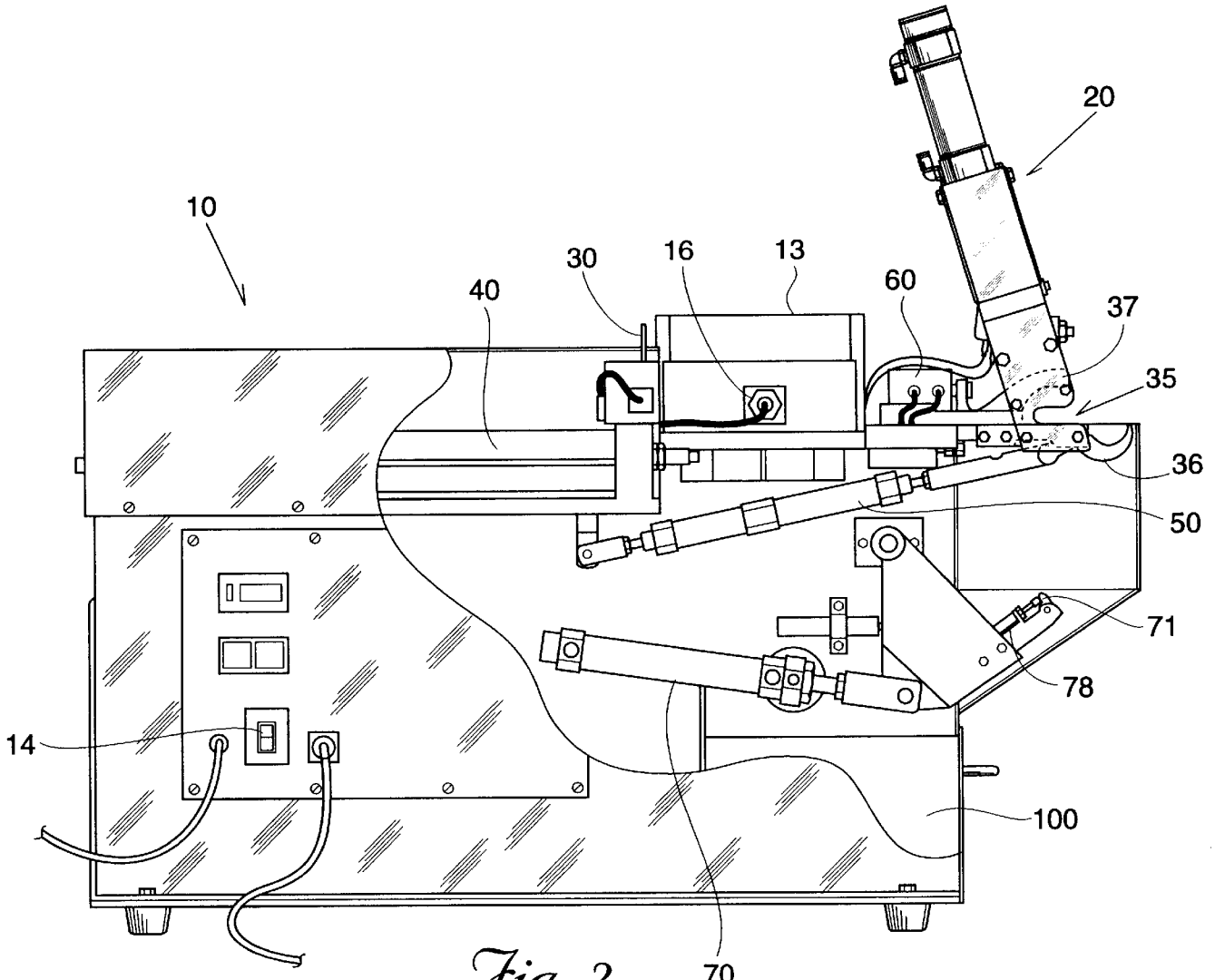
FIG. 2 is a side elevational side view of the apparatus, with portions broken away to illustrate the cooperating components of the present invention.
Figure 4:
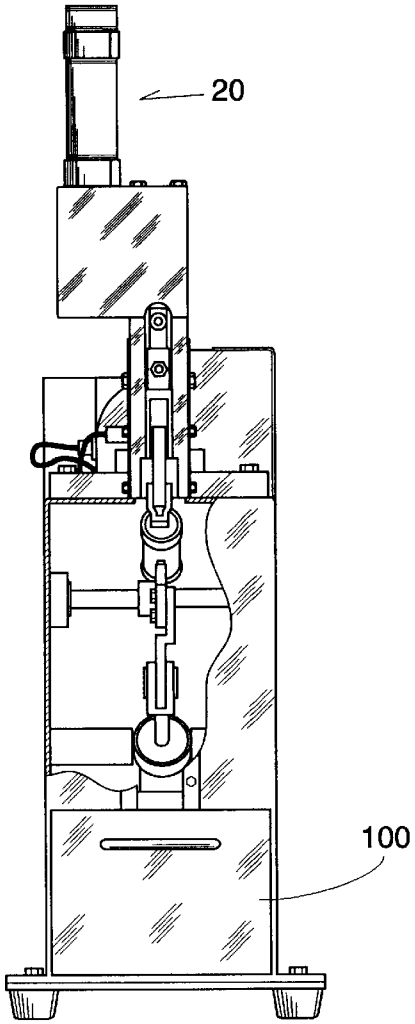
FIG. 4 is a front elevational view of the apparatus, with portions broken away and further illustrating the cooperating elements of this invention.
Figure 3:
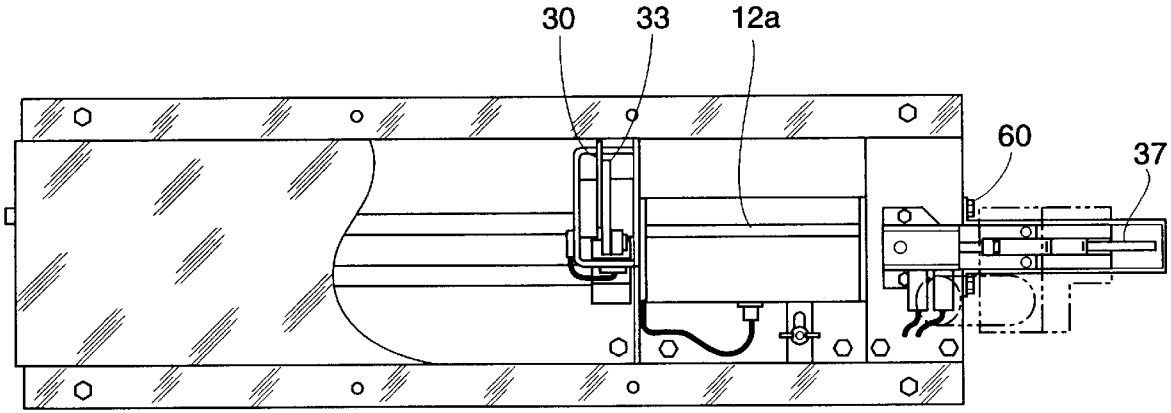
FIG. 3 is a top elevational view of the apparatus, with portions broken away, and also portions shown in phantom.
Figure 8:
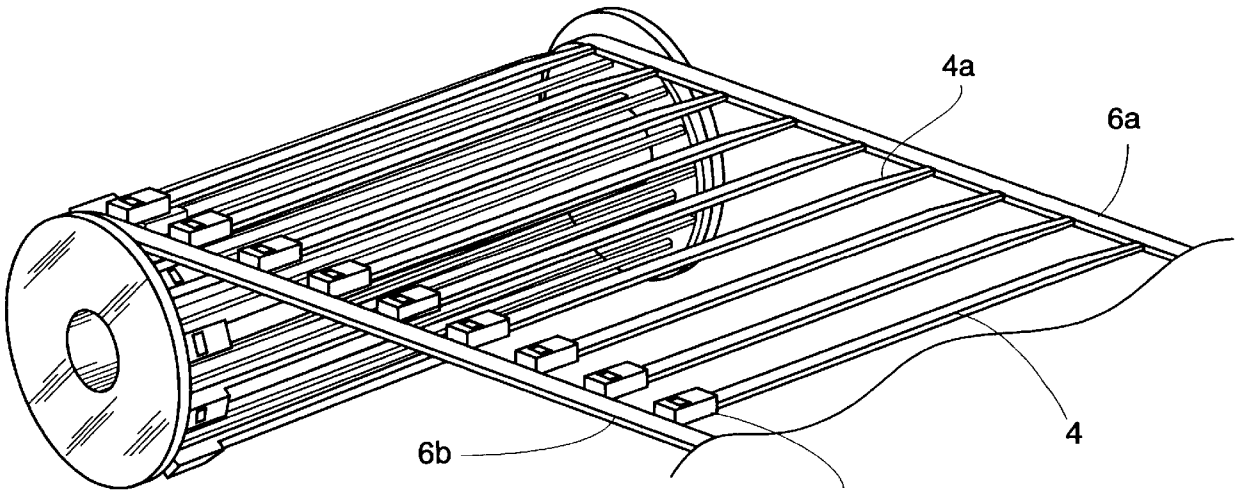
FIG. 8 is a perspective view of a series of cable ties attached on their ends to carrier strips.

As illustrated in FIG. 2, the apparatus 10 is comprised of several cooperating reciprocating extending mechanisms, such as mechanisms 40, 50, 60, and 70. It will be apparent that these mechanisms may be in the form of a pneumatic, air, or hydraulic operated cylinder and plunger combinations as well as solenoid operated reciprocating mechanisms. The apparatus operator calls for individual cable ties for by way of a foot pedal 5 (see FIG. 1). Opposite ends of cable ties 4 are attached during manufacture to parallel carrier strips 6*a* and 6*b* as shown in detail in FIG. 8. The cables ties 4 along with carrier strips 6*a* and 6*b* are normally supplied on reels (see FIG. 8). The tail end portion of the cable ties 4 are denoted by the reference character 4*a* and the apertured head is denoted by the reference character 4*b*.

With reference to FIGS. 3, 5, 7, and 8 it will be noted that the cable tie 4 and carrier strips 6*a* and 6*b* are reeled into the mouth 12*a* of pathway 12 located on top surface of feeder mechanism housing 13. Also located within the housing 13 is a rotatable feeder mechanism 15 positioned on a splined axle 15*a*. The mechanism 15 is preferably elongated for a length substantially coextensive of the length of the cable ties 4 seated thereon.

Figure 6:
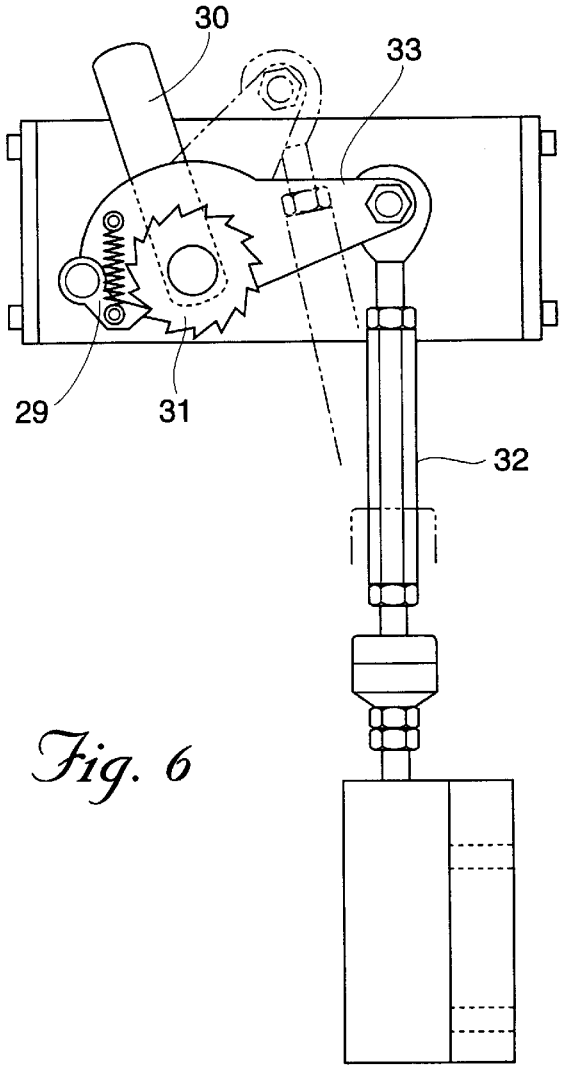
FIG. 6 is an isolated view of a fragment of the apparatus, showing the manual indexing handle and ratchet with portions in phantom.

The feeder mechanism 15 is configured with circumferentially spaced grooves 17 defined by ridges 17*a*, to enable the cable ties 4 to be received therein. With reference to FIG. 6, the feeder mechanism 15 and ratchet 31, moving concurrently therewith, along with the laterally extending lever arm 33, are operated by a reciprocating extending mechanism 32. The ratchet 31, in conjunction with a spring biased pawl 29, provide an escapement mechanism to ensure sequential operation of the feeder mechanism 15.

Figure 5:
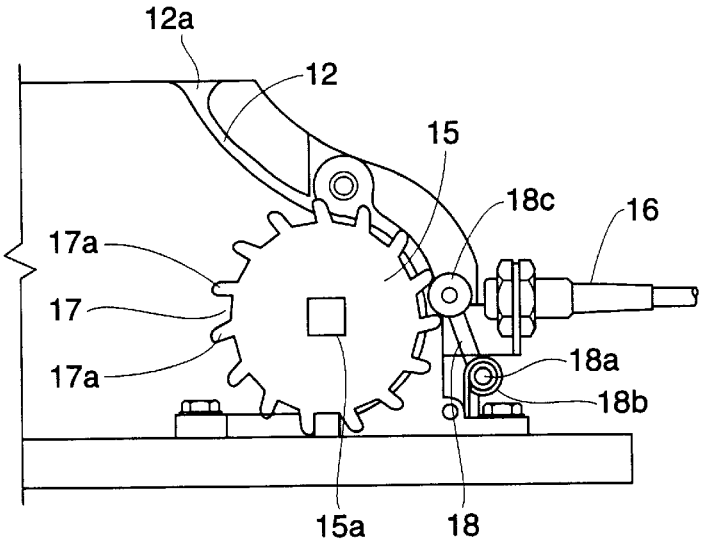
FIG. 5 is an isolated view of a fragment of the apparatus showing the feeder mechanism and proximity sensor.

With particular reference to FIG. 5, the proximity sensor 16 is positioned to sense a signal emanating from a spring loaded arm 18. The arm 18 is pivotally mounted on a stationary fulcrum 18*a* and is normally biased in a counter clockwise direction, as shown in FIG. 5 by the torsion spring 18*b*. The feeder mechanism 15 rotates in a clockwise motion. The arm 18 includes a roller 18*c* which sequentially contacts each of the ridges 17*a*. Pivotal movement of the roller 18*c* provides an "off-on-off" signal to the proximity sensor 16. This signal controls the operational sequence of each of the various reciprocating extending mechanisms 40, 50, 60, 70, and 80. This signal is received by a sequential electrical operating circuit, such as that provided by a programmable logic controller (PLC). It will be apparent that a proximity sensor (not shown) may be positioned to receive signals indicating presence and absence of a cable tie normally resting in a groove 17.

The manually operated indexing handle 30 is also utilized when cable ties 4 are initially fed into the feeder mechanism 15.

Figure 7:
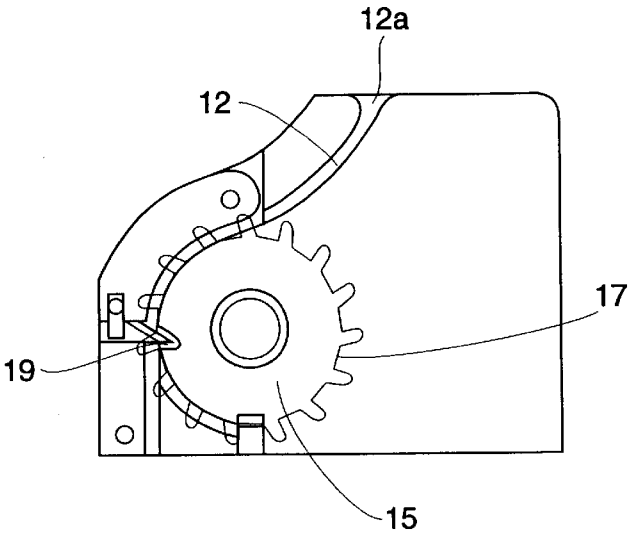
FIG. 7 is an isolated view of a fragment of the apparatus, showing the feeder mechanism and cutting blade and in particular the front cutting blade for severing the tail of a cable tie from its carrier strip.

Referring to FIG. 7, it will be noted that cutting blades 19 are positioned proximate to opposite ends of the feeder mechanism 15 and are arranged to sever the cable ties 4 from the carrier strips 6*a* and 6*b*.

A guillotine tower 20 houses a mechanism with purpose to sever a surplus portion of the workpiece 11. Downward severing movement of the guillotine blade 22 in the direction of the arrow 98 (see FIG. 17) accomplishes this goal. As shown generally in FIGS. 9–11, inclusive, the guillotine tower 20 is operated by way of a reciprocating extending mechanism 23 on which there are air inlets 24 for alternatively supplying air pressure to a plunger rod 26 (see FIG. 9).

Figure 9:
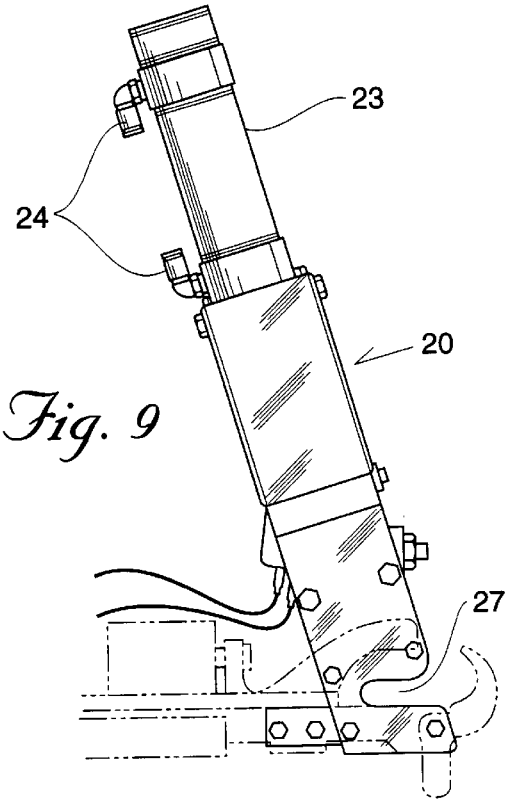
FIG. 9 is a side elevational view of the guillotine cutting mechanism of this invention, with portions in phantom.
Figure 10:
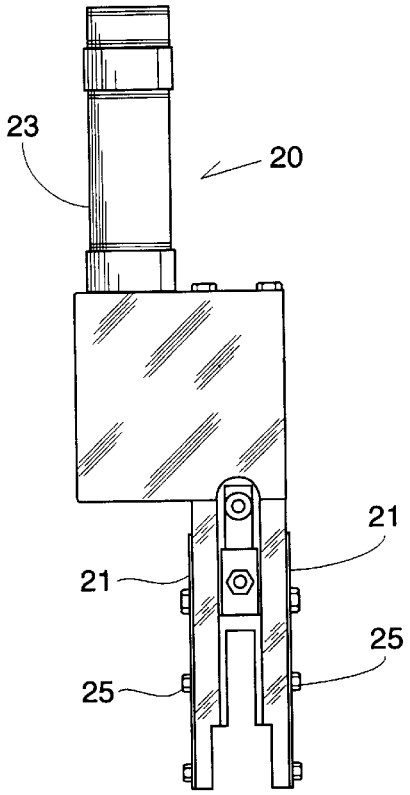
FIG. 10 is an isolated front view of the apparatus further showing the details of the guillotine mechanism of FIG. 9.
Figure 11:
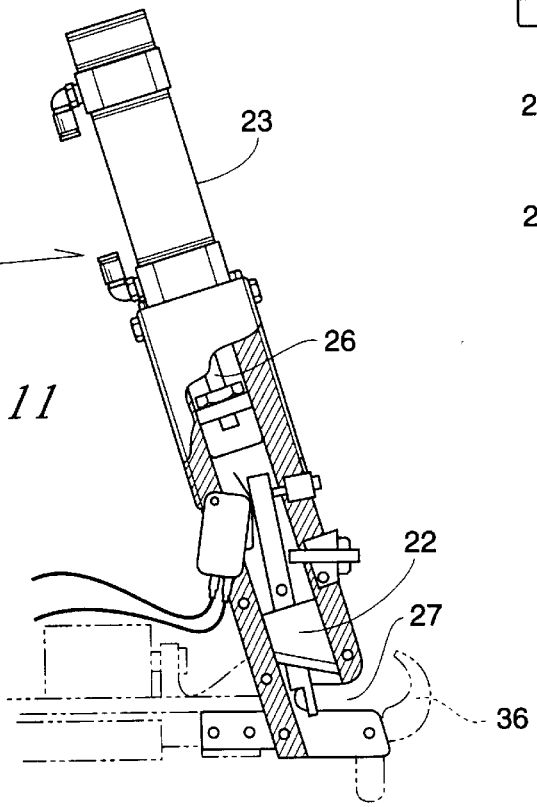
FIG. 11 is an isolated partial side view of the mechanism of FIGS. 9–10 with portions broken away and portions in section.

Returning to FIG. 1, the workpiece 11 is shown positioned for closing, cinching and severing as will be later described herein. While the guillotine blade 22 shown in FIG. 11 is positioned to an operator's left, it is to be understood that screws 25 may be withdrawn to allow removal of the guillotine tower cover 21 in order to facilitate blade 22 position change. In this way the blade 22 may be positioned to allow an operator optional right or left handed operation of the apparatus 10. The lower portion of the guillotine tower 20 as particularly shown in FIG. 9 is slotted at 27. As will herein after be described the slot 27 assists in the cinching of a marginal portion of the workpiece 11.

Figure 12:
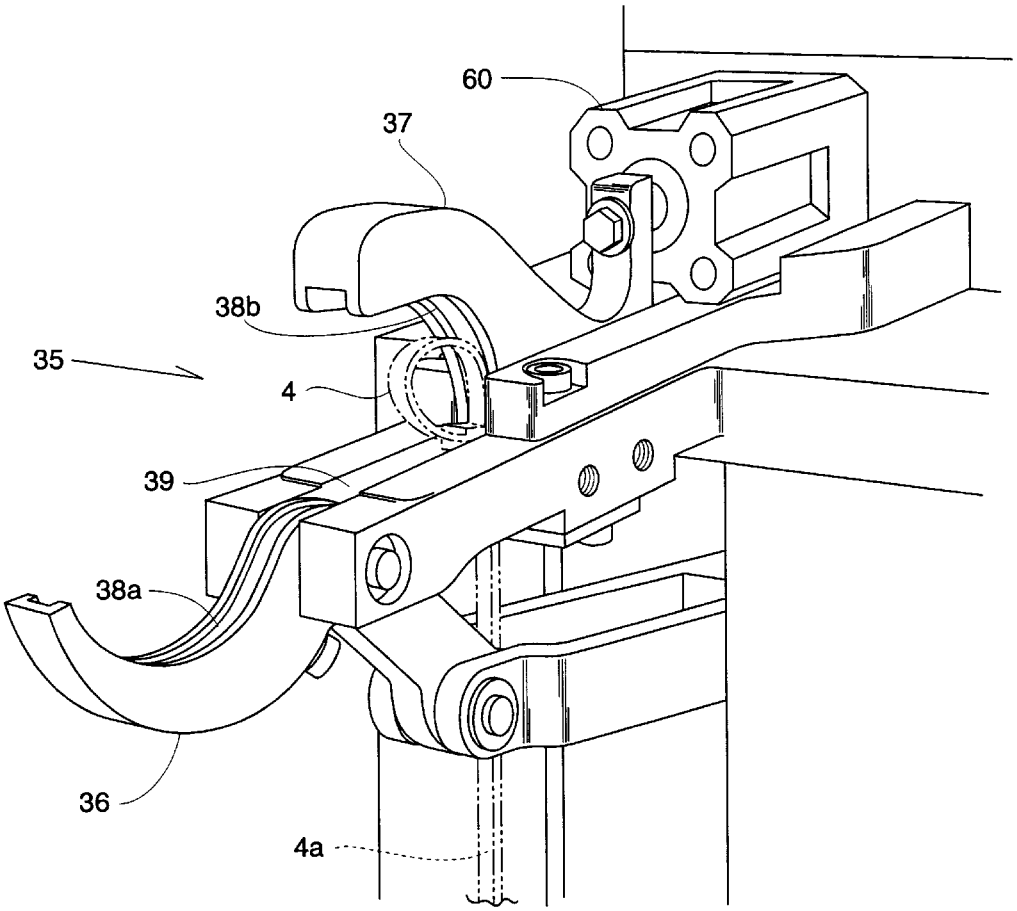
FIG. 12 is a perspective view particularly illustrating the components of the surrounding and tensioning area defined by the cooperating jaw elements of this invention.

FIG. 12 illustrates the surrounding and tensioning area 35, which includes a receiving jaw element 36, and a surrounding jaw element 37. Each jaw element 36 and 37 is grooved to respectively provide channels 38*a* and 38*b*, for receiving the incoming cable ties 4. The cable ties 4 is shown in phantom to illustrate the looped position (with workpiece 11 not shown).

Figure 13:
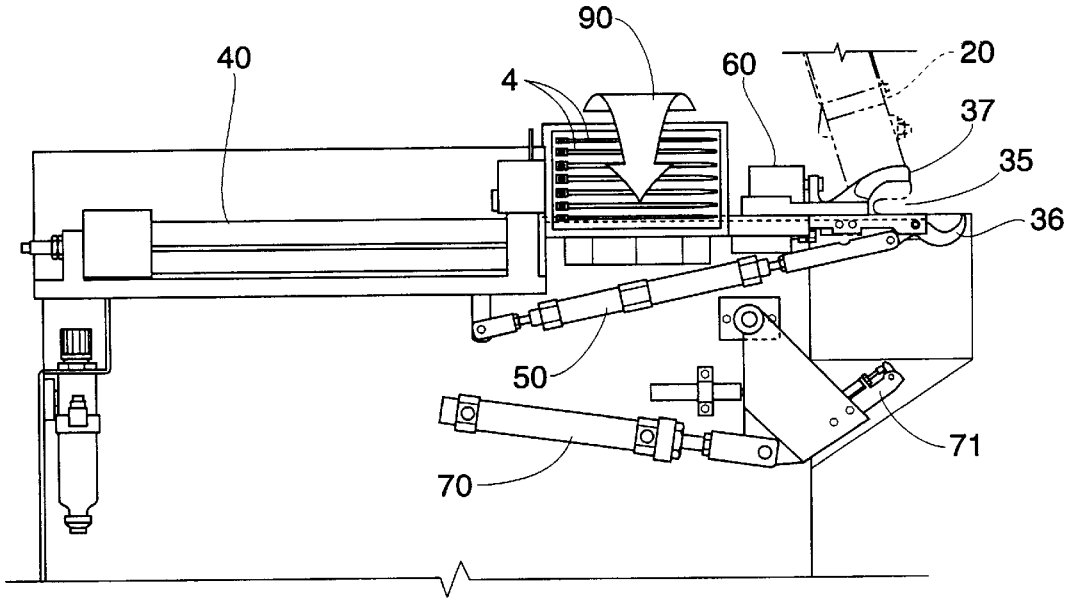
FIGS. 13–17, inclusive, are each partial side views of the apparatus of this invention and illustrate in sequence, the various operating positions of components cooperating to include the feeding, transporting and configuring of individual cable ties to surround and cinch the open end of a pre-positioned workpiece and sever surplus portions of the workpiece, cable tie, and carrier strip.

Attention is directed to the views of FIGS. 12–17, inclusive. To describe the operation of the apparatus of this invention, attention is drawn to the sequentially arranged views of FIGS. 13–17. With particular reference to FIG. 13 it will be observed that the reeled cable ties 4 and carrier strips 6*a* and 6*b* (not shown in this view) are severed from the carrier strips 6*a* and 6*b* as shown and described in connection with FIG. 7. The arrow 90 indicates that the feeder mechanism 15 is rotating. After the bottommost cable tie 4 drops away from its groove 17 into the elongated well 39 (see FIG. 12), it is transported, as shown in phantom, in the direction of the arrow 91*a* by the abutting pressure exerted by the reciprocating extending mechanism 40 (see FIG. 14).

Figure 14:
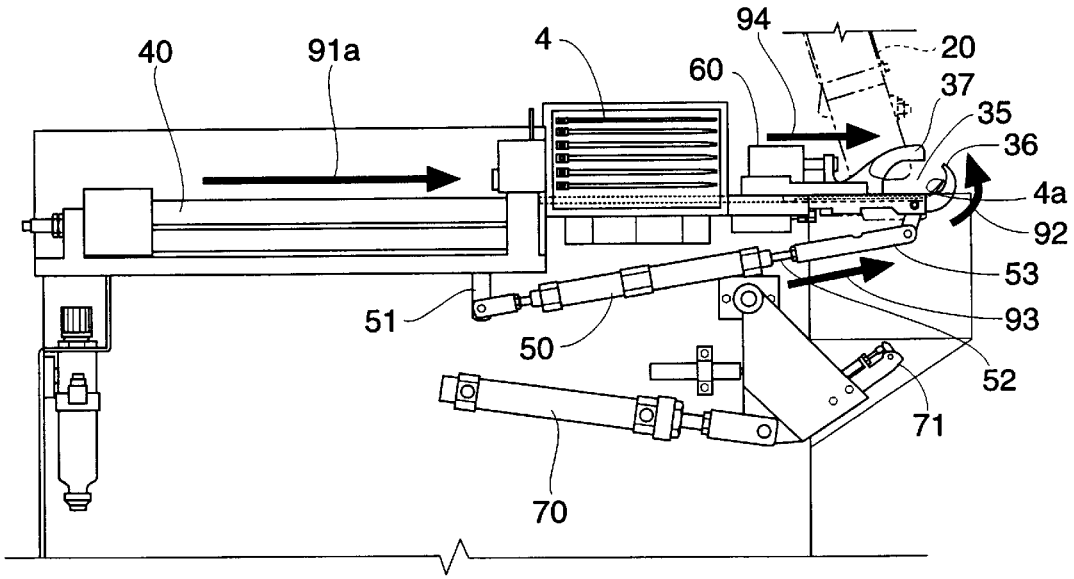

With reference to FIG. 14 it will be observed that the cable tie tail portion 4*a* is cradled in the channel 38*a* of receiving jaw 36. The receiving jaw 36 along with the tail end portion 4*a* is rotated on its pivot in the direction of the arrow 92 by means of the reciprocating extending mechanism 50. The mechanism 50 is pivotally supported at one end by the depending stationary trunion 51 with its plunger 52 operatively joined to the receiving jaw 36 by means of the link 53. The mechanism 50 is initially operated in the direction of the arrow 93 to provide this function.

Figure 15:
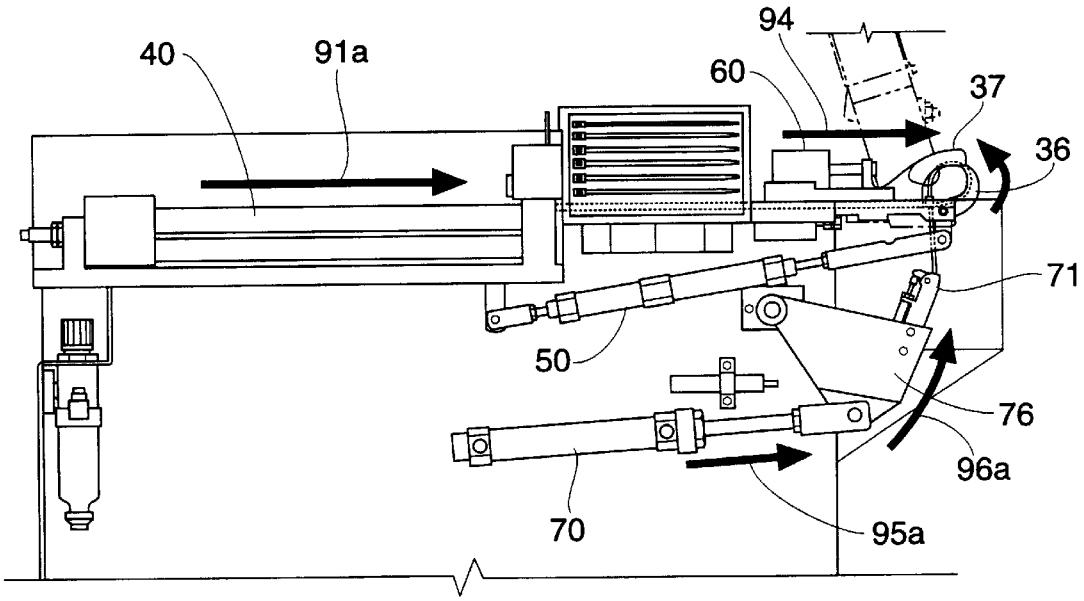

As viewed in FIGS. 14 and 15, the surrounding jaw 37 is pushed forward from its normal operating position as shown in FIG. 13 to its surrounding position in the direction of the arrow 94. In this position the jaw elements 36, 37 have acted to cinch the open end portion of the workpiece 11 (not shown). The means for providing lateral movement to the surrounding jaw 37 may be in the form of an air operated cylinder, a solenoid, or other similar functioning device 60.

Figure 18:
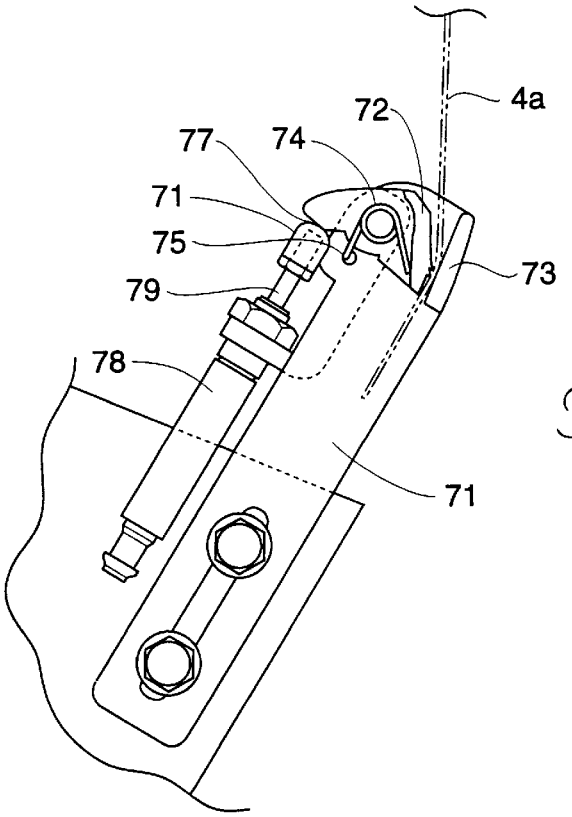
FIG. 18 is an isolated view of a fragment of the apparatus illustrating the grasping and tensioning mechanism with cable tie tail shown in phantom.

Concurrently with the workpiece cinching operation the tail end portion 4*a* will continue in its longitudinal travel to move in the channel 38*b* to be fed into its apertured head 4*b* against the action of a fastening pawl integrally formed therein (not shown). The tail end portion 4*a* will continue in its movement until the cinching operation has been completed and will have been fed into the mouth of a chambered tensioning element 71 (see FIG. 18) but also concurrently therewith the reciprocating extending mechanism 70 will be moved in the direction of arrows 95*a* and 96*a*. Continued movement of the tail end 4*a* will cause the tail end 4*a* to be pinched between a pawl 72 and a wall 73 of the element 71. The pawl 72 is biased toward the wall 73 by means of a tension spring 74 having a stationary end anchored in the opening 75 formed in the opening of the tensioning element 71.

Figure 16:
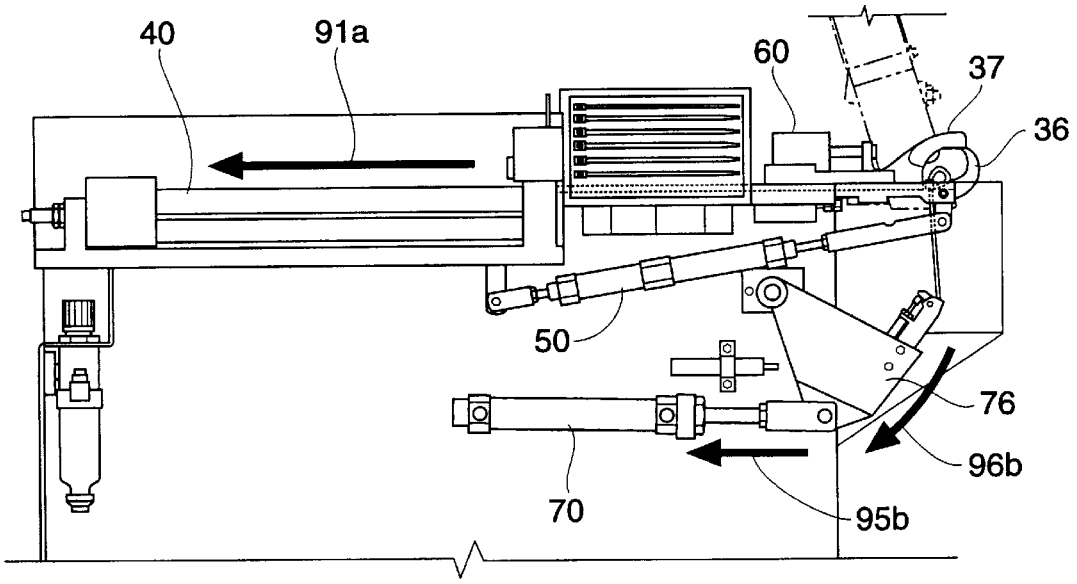
Figure 19:
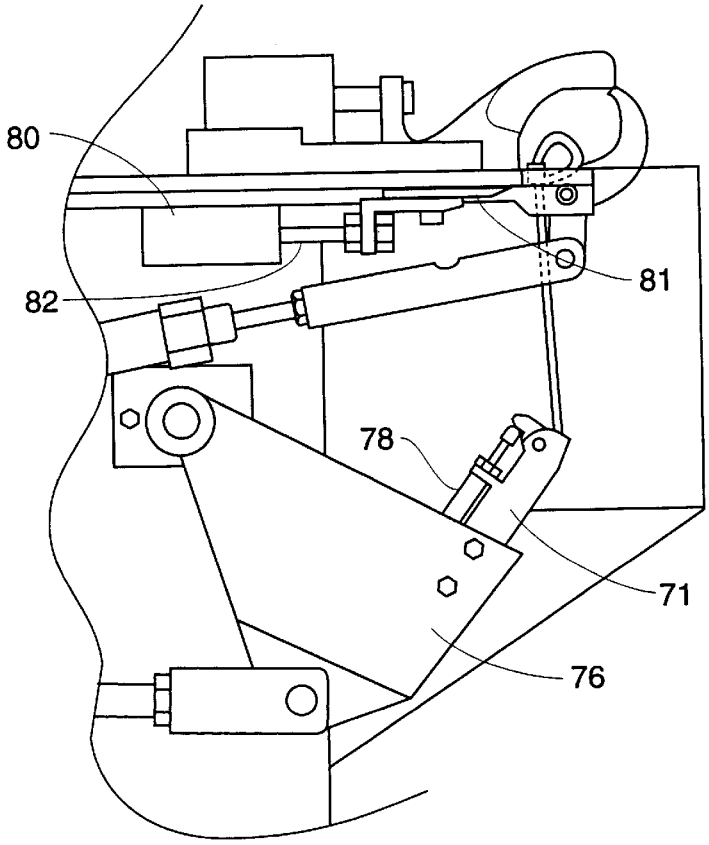
FIG. 19 is an isolated view of a fragment of the apparatus illustrating the grasping and tensioning mechanism along with cutting apparatus for severing surplus cable tie.

Next with reference to FIGS. 16 and 19, the tensioning element 71 and the tail end 4*a* will be tensioned to draw the cable tie 4 into the tightest cinching position shown by the phantom lines of FIG. 12. This is accomplished by means of clockwise rotation of the pivoted support member 76. The tensioning element 71 is secured at the outer end of the pivoted support member 76. The pivoting support member 76, the tensioning element 71 and the tail end 4*a* will be pulled in the direction of the arrows 95*b* and 96*b* in FIG. 16 by means of the reciprocating extending mechanism 70. The sequence operated by the PLC (not shown) insures that the reciprocating extending mechanism 40 returns to its initial operating position shown as the arrow 91*b*.

Figure 17:
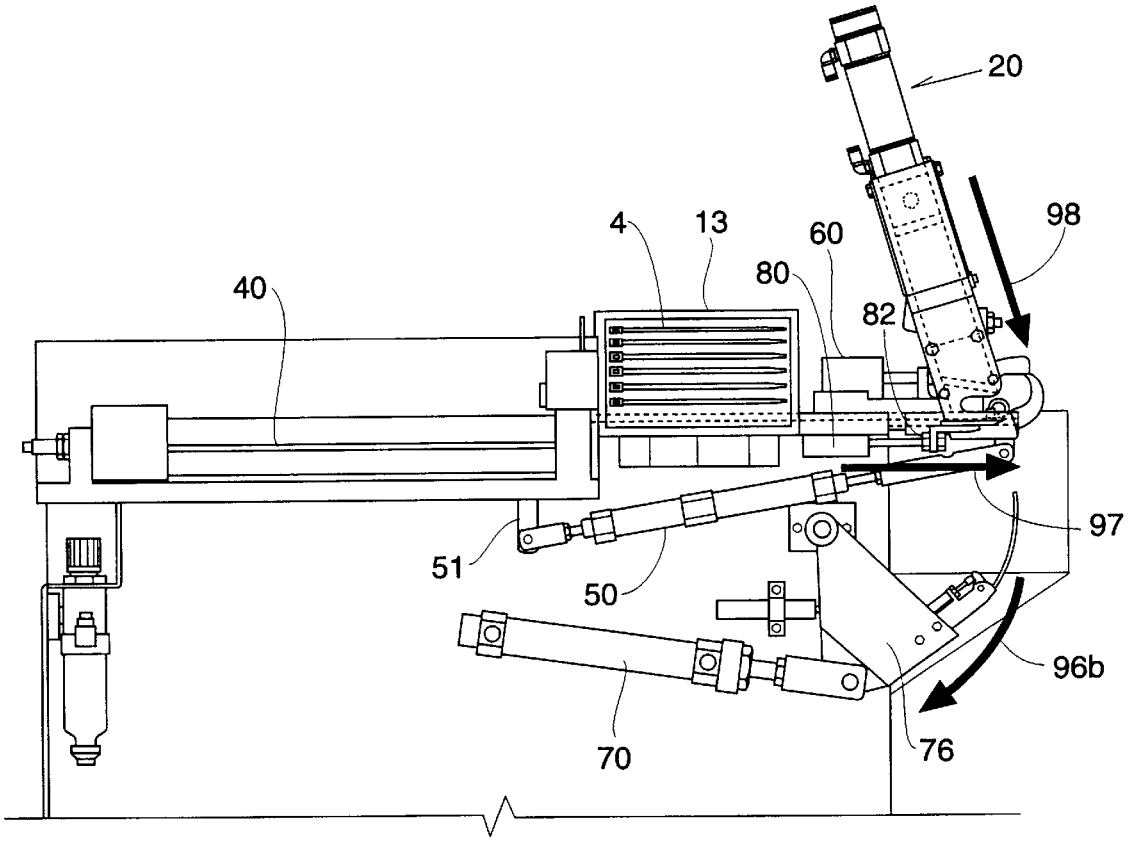

With reference to FIGS. 17 and 19, it will be observed that the surplus tail end portion 4*a* is tensioned in the direction of the arrow 96*b* until its is severed by means of a knife blade 81 carried by movement of the plunger 82 in the direction of the arrow 97 and extending from the reciprocating extending mechanism 80. Again with reference to FIG. 18, release of the tail end 4*a* will be caused by abutment of the tip 77 with the extending end of the pawl 72. This action is caused by activation of the solenoid 78 and its plunger 79 supporting the tip 77. A blast of air from a nozzle (not shown) connected to a pressurized air source also aids in the release of the tail end 4*a*.

It will be further observed from FIGS. 1 and 2 that severed free tail ends 4*a* and the carrier strips 6*a* and 6*b* are directed downwardly to be received in a waste receptacle such as the drawer 100.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for supplying and closing workpieces with cable tie in synchronized sequence and capable of handling cable ties for closing an open end portion of a workpiece, said cable tie having an apertured head end and a tail end, said apertured head end having means for retaining said tail end in a fastening position, said apparatus comprising;

a feeder mechanism for supplying said cable ties to said apparatus;

a jaw mechanism having a means for guiding and receiving said cable tie and comprising a receiving jaw element and a surrounding jaw element, a first reciprocating extending mechanism arranged to transport said cable ties toward said receiving jaw element;

a second reciprocating extending mechanism arranged to move said receiving jaw element toward said surrounding jaw element;

a third reciprocating extending mechanism arranged to move said surrounding jaw element toward said receiving jaw element;

said receiving jaw element and said surrounding jaw element cooperating with one another to guide and force said tail end of said cable tie into and through said apertured head end thereof;

means for receiving and grasping said tail end;

a fourth reciprocating extending mechanism cooperating with said receiving and grasping means to tension said tail end;

means for severing a surplus portion of said tail end; and means for severing a surplus portion of said workpiece.

2. The apparatus of claim 1, wherein said cable ties are fastened and transported by a carrier strip and wherein said apparatus includes means for receiving said cable ties and means for transporting and forming said cable ties.

3. The apparatus of claim 2, wherein said surface of said feeder mechanism has circumferential grooves spaced to receive individual cable ties.

4. The apparatus of claim 2 further including means to sever said carrier strip.

5. The apparatus of claim 1, wherein the surface of said feeder mechanism is configured to receive individual cable ties.

6. The apparatus of claim 1 wherein said jaw elements have inner concave surfaces.

7. The apparatus of claim 6, wherein said inner concave surfaces are channeled to receive and guide said cable tie.

8. The apparatus of claim 1, wherein at least certain of said reciprocating extending mechanisms comprise an air cylinder.

9. The apparatus of claim 1, wherein said means for receiving and grasping said tail end of said cable ties includes a pawl mechanism for releasably engaging said cable tie.

10. The apparatus of claim 1, wherein said means for severing said surplus portion of said tail end is comprised of a blade mechanism.

11. The apparatus of claim 1 further including means for sensing a signal.

12. The apparatus of claim 11 wherein said means for sensing a signal is a proximity sensor.

13. An apparatus for supplying and closing workpieces with cable tie in synchronized sequence and capable of handling cable ties for closing an open end portion of a workpiece, said cable tie having an apertured head end and a tail end, said apertured head end having means for retaining said tail end in a fastening position, said apparatus comprising;

a feeder mechanism for supplying said cable ties to said apparatus;

a jaw mechanism having a means for guiding and receiving said cable tie and comprising a receiving jaw element and a surrounding jaw element, a first reciprocating extending mechanism arranged to transport said cable ties toward said receiving jaw element, a second reciprocating extending mechanism arranged to move said receiving jaw element toward said surrounding jaw element;

a third reciprocating extending mechanism arranged to move said surrounding jaw element toward said receiving jaw element;

said receiving jaw element and said surrounding jaw element cooperating with one another to guide and force said tail end of said cable tie into and through said apertured head end thereof;

means for receiving and grasping said tail end;

a fourth reciprocating extending mechanism cooperating with said receiving and grasping means to tension said tail end;

means for severing a surplus portion of said tail end; and means for collecting severed surplus portions of cable tie ends, carrier strip, and workpiece.

14. The apparatus of claim 13, wherein said cable ties are fastened and transported by a carrier strip and wherein said apparatus includes means for receiving said cables ties and means for transporting and forming said cable ties.

15. The apparatus of claim 14, wherein said surface of said feeder mechanism has circumferential grooves spaced to receive individual cable ties.

16. The apparatus of claim 14 further including means to sever said carrier strip.

17. The apparatus of claim 13, wherein the surface of said feeder mechanism is configured to receive individual cable ties.

18. The apparatus of claim 13, wherein said jaw elements have inner concave surfaces.

19. The apparatus of claim 18, wherein said inner concave surfaces are channeled to receive and guide said cable tie.

20. The apparatus of claim 13, wherein at least certain of said reciprocating extending mechanisms comprise an air cylinder.

21. The apparatus of claim 13, wherein said means for receiving and grasping said tail end of said cable ties includes a pawl mechanism for releasably engaging said cable tie.

22. The apparatus of claim 13, wherein said means for severing said surplus portion of said tail end is comprised of a blade mechanism.

23. The apparatus of claim 13 further including means to sever a surplus portion of said workpiece.

24. A method for closing the end of an open ended workpiece comprising the steps of:

supplying a cable tie having an apertured head end and a tail end;

supplying and operationally positioning said open ended workpiece relative to said cable tie;

guiding and looping said cable tie around the open end of said workpiece;

guiding the tail end through the apertured head end;

grasping and tensioning said tail end to cinch said cable tie and provide closure to said workpiece; and severing a surplus portion of said workpiece.

25. The method of claim 24 further comprising the step of severing a free tail end portion of said cable tie.

26. The method of claim 24 wherein the cable tie is attached at least one end to a carrier strip and severing said carrier strip from said cable tie.

* * * * *